United States Patent [19]

DeRoseau

[11] Patent Number: 4,930,637

[45] Date of Patent: Jun. 5, 1990

[54] COMBINATION FOOD CONTAINER AND EATING UTENSIL

[76] Inventor: Robert F. DeRoseau, 4296 Lake Knolls, Oxford, Mich. 48051

[21] Appl. No.: 232,802

[22] Filed: Aug. 16, 1988

[51] Int. Cl.[5] ..... A45C 11/20

[52] U.S. Cl. ..... 206/541; 206/216; 220/23; 229/1.5 C

[58] Field of Search ..... 206/216, 217, 218, 234, 206/541, 223; 220/23, 85 D; 229/1.5 C

[56] References Cited

U.S. PATENT DOCUMENTS

| | | | |
|---|---|---|---|
| 1,257,057 | 2/1918 | White | 229/1.5 C |
| 1,324,682 | 12/1919 | McIntyre | 229/1.5 C |
| 1,514,379 | 11/1924 | Fleischer . | |
| 1,625,335 | 4/1927 | Schneider . | |
| 2,353,582 | 7/1944 | Pearson . | |
| 3,381,876 | 5/1968 | Biggins | 229/1.5 C |
| 3,624,787 | 11/1971 | Newman | 220/23 |
| 3,679,093 | 7/1972 | Chang . | |
| 3,722,779 | 3/1973 | Chang | 229/1.5 C |
| 3,796,813 | 3/1974 | Kurland | 220/23 |
| 4,036,398 | 7/1977 | Hoogvelt et al. | 229/1.5 C |
| 4,534,469 | 8/1985 | Elsmo | 206/218 |
| 4,785,931 | 11/1988 | Weir et al. | 220/23 |
| 4,789,064 | 12/1988 | Segal | 229/1.5 C |

FOREIGN PATENT DOCUMENTS

| | | | |
|---|---|---|---|
| 381606 | 10/1964 | Switzerland | 220/85 D |

*Primary Examiner*—David T. Fidei
*Attorney, Agent, or Firm*—Alex Rhodes

[57] ABSTRACT

A combination food and utensil container for the sanitary storing of prepared food, by way of example, frozen dinners and restaurant carryouts, and the utensils and flavor enhancing substances which are needed for the partaking of the food. The food container has body for storing and preserving food whose height is substantially less than its length and breadth, a cover sealingly attached to the upper edge portion of body and a plurality of utensils attached to the lower surface of the cover. The utensils are removably attached to the lower surface of the body by engaging pairs of apertures in the utensils with circular projections which extend downwardly from the lower surface of the cover. Downward extending pockets with removable covers are provided in the main cover for storing flavor enhancing substances.

5 Claims, 1 Drawing Sheet

COMBINATION FOOD CONTAINER AND EATING UTENSIL

BACKGROUND OF THE INVENTION

This invention relates to food containers and more particularly to disposable food containers for preserving food, by way of example, frozen dinners and restaurant carryouts, which include eating utensils. One aspect of the current practice is that containers for prepared foods do not include knives, spoons or forks for partaking of the foods. The objection to this practice is that the utensils are often inadvertently omitted or not available at the sources of the foods.

Another aspect of the current practice is that the food utensils which are supplied with prepared foods are generally supplied without outer wrappings. The objection to this practice is that unwrapped utensils pose a health risk.

Despite the benefits of providing eating utensils in food containers, none of the combination food container and utensil concepts of the prior art have achieved commercial success. It is believed that the reasons they have not achieved success is the added cost and/or functional deficiencies.

Fleischer U.S. Pat. No. 1,514,379, Schneider U.S. Pat. No. 1,625,335, Pearson U.S. Pat. No. 2,353,582 and Chang U.S. Pat. No. 3,679,093 are exemplary of food containers having utensils in the prior art.

Fleischer U.S. Pat. No. 1,514,379, more than sixty years ago, patented a construction for an ice cream cup with a cover containing a spoon. The cover was comprised of a bottom member and a top sheet of waterproof paper bonded to an outwardly-extending flange portion of the bottom member.

Shortly after Fleischer patented his ice cream cup, Schneider U.S. Pat. No. 1,625,335 patented an ice cream cup having a paper cover with an exposed utensil portion which was separable from the cover along a tear line.

Pearson U.S. Pat. No. 2,353,582 patented an ice cream cup having a cover formed of a plurality of layers and a partially exposed spoon stored between the layers of the cover.

Chang U.S. Pat. No. 3,679,093 patented a food container having a utensil enclosed in a compartmented cover which was accessible by severing a portion of the outer covering along a perforated line.

In view of the objections to the current practice and the variety of concepts for a combination food and utensil container which have long been available in the prior art, it will be appreciated that a long felt need exists which, as yet, remains unsatisfied.

SUMMARY OF THE INVENTION

The present invention is a disposable combination food container and eating utensil. It is contemplated that the invention will be used by the general public for purposes such as, picnics and student and worker box lunches as well as for commercially prepared foods, such as, frozen foods and restaurant carryouts.

The invention resides in providing utensils and food enhancing substances for the partaking of food, by way of example, restaurant carryouts and frozen dinners, in a disposable food container. The invention comprises a body for storing and preserving food whose height is substantially less than its length and breadth, a main cover sealingly attached to the upper edge portion of the body and a plurality of utensils attached to the lower surface of the cover. The utensils are removably attached to the lower surface of the body by engaging pairs of apertures in the utensils with circular projections which extend downwardly from the lower surface of the cover. Downward extending pockets with removable covers are provided in the main cover for storing flavor enhancing substances.

The foregoing objects, features, and benefits along with other objects, features and benefits as well as the manner of practicing the invention in accordance with the best mode contemplated will be understood from the ensuing description and accompanying drawings which described the invention in detail.

DETAILED DESCRIPTION OF THE PREFERRED EMBODIMENT

Figure 1:
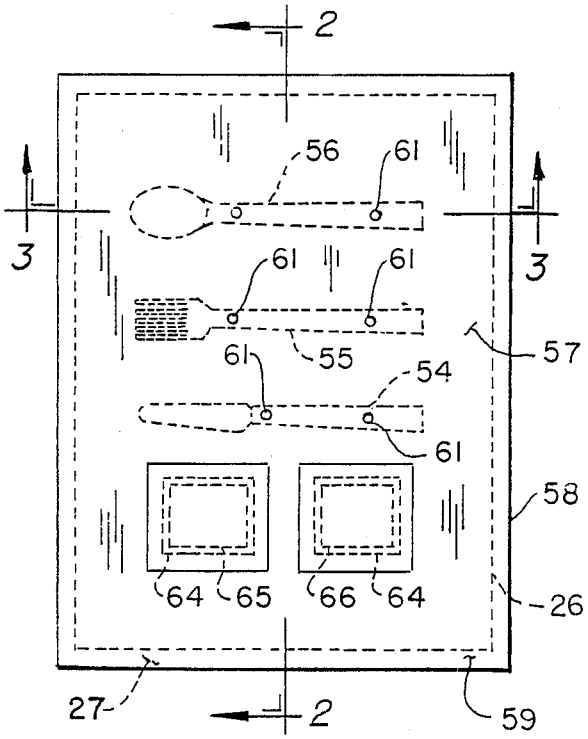
FIG. 1 is a plan view of a container having multiple utensils stored inside the container by suspending the utensils from the inner surface of the cover.

Referring now to the drawings wherein like numerals designate like and corresponding parts throughout the several views, the present invention of a combination food and utensil container 20 comprises a body 21 having a sealed pocket 57 for storing an eating utensil 23 and at least one eating utensil 23 protectively stored in the pocket 22 of the container 20. An important benefit of the invention is that utensils flavor enhancing substances are provided in sealed pockets of a container at a lower cost than heretofore possible.

Figure 2:
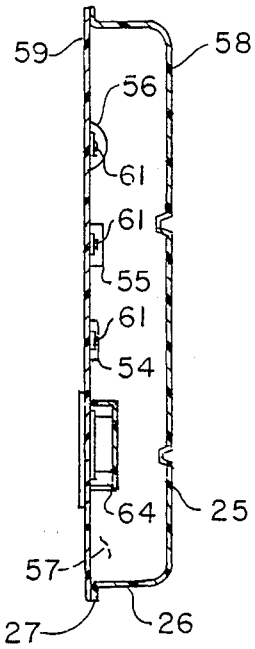
FIG. 2 is a vertical section taken on the line 2—2 of FIG. 1.
Figure 3:
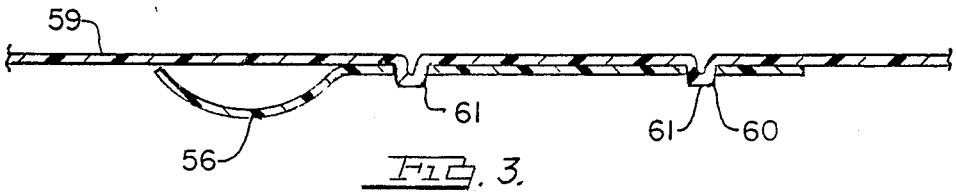
FIG. 3 is an enlarged vertical section taken on the line 3—3 of FIG. 1.
Figure 4:
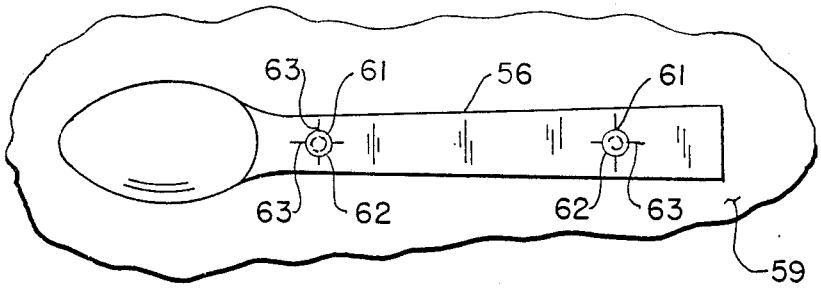
FIG. 4 is a bottom view of FIG. 3.

With reference to FIGS. 1–4, in the particular embodiment 58 disclosed therein, a rectangular body 24 has a bottom wall 25, an upward-extending peripheral wall 26 and an outward-extending flange 27. A flat cover 56 is adhesively bonded to the flange 27.

In FIGS. 8 through 12 inclusive, a knife 54, fork 55 and spoon 56 are stored in the pocket 57 of a container 58 by attaching the utensils to the inner surface of the cover 59 by a mechanical joining means 60. The mechanical joining means 60 comprises pairs of cylindrical downward-extending projections 61 in the cover 59 and corresponding pairs of apertures 62 in the handle portions of each utensil which grip the projections 61 of the cover 59. The outer edges of the apertures 62 preferably have radial slits 63 to reduce the force that is required to engage the apertures 62 with the projections 61. The embodiment 58 further has a pair of pockets 64 in the cover of similar construction to those pockets of FIGS. 1 through 4 wherein condiments such as salt 65 and pepper 66 are stored.

From the foregoing detailed description it will be appreciated that my invention provides a combination food and utensil container free of contamination which contains all of the utensils and food enhancing substances which are needed for the partaking of the food.

Although but one embodiment of my invention have been described, it will be appreciated that other embodiments can be provided by changes in size, shape, materials and arrangement of parts without departing from the spirit hereof.

I claim:

1. A combination food and utensil container for storing and partaking of food in a sanitary manner comprising in combination, a body which is adapted for preserving food, said body having a height which is substantially less than its length and breadth, a bottom wall and an upward extending side wall adjoining the periphery of said bottom wall; a detachable first cover in sealing relationship to said body fixed to the upper edge portion of said body side wall, said first cover having at least one pocket extending downwardly from the outer surface thereof which is adapted for storing a substance for enhancing the flavoring of said food; a second cover detachably bonded to the outer surface of the first said cover for enclosing said pocket; at least one eating utensil in the interior of said container, said utensil attached to the inner surface of said first cover; and a means for attaching said utensil to the inner surface of said first cover.

2. The combination food container and utensil container recited in claim 1 comprising more than one eating utensil attached to the lower surface of said cover.

3. The combination food and utensil container recited in claim 1 wherein said body is a rectangular shaped body comprising a rectangular lower wall and an upward-extending peripheral rectangular wall.

4. The combination food and utensil container recited in claim 1 wherein said means for attaching said utensil to said cover is a gripping means.

5. A combination food and utensil container which is adapted for storing and partaking of frozen dinners and restaurant carryout foods in a sanitary manner comprising in combination, a body which is adapted for receiving frozen dinners and restaurant carryouts, said body having a height which is substantially less than its length and breadth, a bottom wall and an upward extending side wall, adjoining the periphery of said bottom wall; a detachable first cover in sealing relationship to said body, said cover fixed to the upper edge portion of said body side wall and having pairs of downward extending circular projections for attaching utensils to the lower surface of said cover; multiple eating utensils retained to said cover, each of said utensils having a pair of apertures with radial slits for retaining said utensil in removable gripping relationship to said circular projections and means in said cover for storing substances for enhancing the flavoring of said food.

* * * * *